United States Patent [19]

Samuelson et al.

[11] 4,087,318

[45] May 2, 1978

[54] OXYGEN-ALKALI DELIGNIFICATION OF LIGNOCELLULOSIC MATERIAL IN THE PRESENCE OF A MANGANESE COMPOUND

[75] Inventors: Hans Olof Samuelson; Kjell Evert Abrahamsson, both of Gothenburg, Sweden

[73] Assignee: Mo och Domsjo Aktiebolag, Ornskoldsvik, Sweden

[21] Appl. No.: 754,717

[22] Filed: Dec. 27, 1976

Related U.S. Application Data

[63] Continuation-in-part of Ser. No. 555,755, Mar. 6, 1975, abandoned.

[30] Foreign Application Priority Data

Mar. 14, 1974 Sweden ..... 7403451

[51] Int. Cl.[2] ..... D21C 1/00; D21C 3/02; D21C 3/04

[52] U.S. Cl. ..... 162/60; 162/65; 162/70; 162/76; 162/79; 162/80; 162/81; 162/86; 162/89

[58] Field of Search ..... 162/65, 60, 70, 72, 162/76, 79, 80, 81, 83, 84, 86, 87, 88, 89, 90; 8/111

[56] References Cited

U.S. PATENT DOCUMENTS

| | | | |
|---|---|---|---|
| 1,860,432 | 5/1932 | Richter | 162/65 |
| 2,511,096 | 6/1950 | Bate | 162/65 |
| 2,811,518 | 10/1957 | Mitchell et al. | 162/65 X |
| 3,701,712 | 10/1972 | Samuelson et al. | 162/65 |

FOREIGN PATENT DOCUMENTS

| | | | |
|---|---|---|---|
| 49,503 | 1/1974 | Japan | 162/65 |
| 344,054 | 8/1972 | U.S.S.R. | 162/65 |

OTHER PUBLICATIONS

Landucci et al, "Influence of Metal & Iodide Ions in Oxygen Pulping of Southern Pine", A.B.I.P.C., vol. 44, No. 6, 7-1973, #6161.

*Primary Examiner*—Arthur L. Corbin

[57] ABSTRACT

A process is provided for the delignification of lignocellulosic material wherein the lignocellulosic material, prior to the delignification, is treated with water or an aqueous solution to remove compounds which catalyze the degradation of carbohydrates and then the delignification is carried out with oxygen and alkali in the presence of a manganese compound to improve the selectivity of the delignification and increase the rate of delignification.

22 Claims, No Drawings

OXYGEN-ALKALI DELIGNIFICATION OF LIGNOCELLULOSIC MATERIAL IN THE PRESENCE OF A MANGANESE COMPOUND

This application is a continuation-in-part of Ser. No. 555,755, filed Mar. 6, 1975, and now abandoned.

The conversion of raw lignocellulosic material to unbleached and then to bleached pulp requires an extremely complex and intricate series of chemical reactions and physical process, usually requiring two or more stages in which different reactions are involved. The first is referred to as pulping, and the second as bleaching. Both however include delignification.

Rydholm in *Pulping Processes* has pointed out that the common purpose of all chemical pulping processes is to achieve fiber liberation by delignification, and they can be classified according to their different ways of achieving this. Reactions with the carbohydrates occur at the same time, and dissolution of certain amounts of the carbohydrates and chemical modification of the remainder determine the quality of both dissolving and paper pulps, and are therefore controlled accordingly. Dissolution of the extraneous components of wood is important to pulp quality. Inorganic side reactions occur, which are of importance not only for the regeneration of the pulping chemicals, but indirectly for the reactions with the wood during the cook.

Alkaline delignification results in alkaline hydrolysis of the phenolic ether bonds, whereby lignin is rendered soluble in alkali. Sulfidation by hydrosulfide in the Kraft process may both accelerate the cleavage of phenolic ether bonds and cause direct cleavage of alkyl ether bonds, as well as protect alkali-sensitive groups from a condensation which could retard the delignification. Sulfonation of benzyl alcohol and alkyl ether groups in the sulfite process renders the lignin water-soluble; the cleavage of the alkyl ether bonds, which keep the initially formed lignosulfonates bound to the wood, occurs by sulfitolysis or acid hydrolysis. At the same time sulfonation of the reactive groups prevents their partaking in condensation reactions. Neutral sulfite pulping, which involves less delignification, utilizes sulfonation of certain groups in the lignin to hydrophilic sulfonates, the dissolution of which is effected by unknown reactions, which may involve both sulfitolysis and hydrolysis. Finally, nitration and chlorination of lignin, used in some minor pulping processes, together with some oxidation, as in oxygen-alkali pulping, cause changes at the aromatic nuclei of lignin, which lead to decomposition of the lignin macromolecules to smaller fragments, soluble in water or alkali.

In all delignification, one side reaction of lignin is most undesirable, its self-condensation, which occurs in both acid and alkaline medium, rendering the lignin less soluble and dark in color, which darkens the color of the pulp. Chemical pulping cannot entirely avoid lignin condensation, and the lignin remaining in the pulp after cooking is more or less condensed. The purpose of the bleaching reactions is to cause such degradation of these lignin molecules that they can be dissolved, and thus improve the color of the pulp.

Although in most pulp uses lignin is an undesirable or at best inert component of the pulp, no preparation of unbleached pulp aims at complete delignification. This is primarily because of the unavoidable reactions with the carbohydrates during the delignification. These reactions become particularly serious towards the end of the cook, when the rate of delignification is slow, because of the small amounts of lignin remaining and their high degree of condensation or inaccessibility. When pulps with a high content of hemicellulose are desired, considerable amounts of lignin are left in the pulp. For unbleached pulps the upper limits are set by the brightness and brightness stability required, as well as the extent to which lignin can be allowed to impair the beating and strength properties of the pulp. In the case of bleached pulps the cost of bleaching agents is the limiting factor.

The alkaline degradation of carbohydrates starts at the aldehydic end groups and proceeds along the chains in a sort of peeling reaction with conversion of the sugar monomers to saccharinic and other hydroxy acids. This reaction occurs fairly rapidly at 100° C and therefore precedes delignification. At higher temperatures there occurs a direct alkaline hydrolysis of the glycosidic bonds, which also affects the more crystalline parts of the carbohydrates. This reaction not only leads to new losses of yield by peeling reactions starting at the freshly formed aldehydic groups, but also to a shortening of the cellulose chains and a deterioration of the strength properties of the pulp. Another reaction, involving an intramolecular rearrangement, causes a stabilization of the carbohydrate molecules under formation of a carboxyl end group.

The selectivity of the pulping chemicals with respect to delignification determines the yield of the pulping process and to some extent the pulp properties. In the sulfite process, sulfonation and acid hydrolysis contribute to delignification, and acid hydrolysis to the carbohydrate degradation and dissolution. In the Kraft process, sulfidation and alkaline hydrolysis contribute to delignification, and alkaline peeling and hydrolysis to the carbohydrate degradation. The delignification proceeds more rapidly in the sulfite cook than in the Kraft cook, and lower temperatures can therefore be used in the former, which is fortunate because the hydrolysis of the glycosidic bonds of the carbohydrates occurs much more rapidly in acidic than in alkaline medium. Alkaline peeling reactions, on the other hand, require lower temperature than the alkaline delignification, and they unavoidably decrease the carbohydrate yield, to a degree which depends on both chemical and physical changes in their structure. Accessibility phenomena improve the selectivity of lignin removal.

It is a consequence of the above phenomena that the rate of pulping is governed mainly by the rate of delignification. Of the delignification reactions mentioned above, chlorination is most rapid and occurs at a technically acceptable rate also at room temperature. Nitration is somewhat slower, but can be performed at temperatures below 100° C without overlong reaction times. However, the remaining reactions, which involve the least expensive chemicals and are accordingly the most important, unfortunately require elevated temperatures and pressures to proceed sufficiently rapidly. This causes an expensive heat consumption, expensive pressure vessel constructions, and difficulties in the construction of continuously operating machinery because of the problem of feeding chips against a reaction zone of elevated pressure.

These problems naturally have led to investigation of possible catalysts for the reactions concerned.

Autooxidation reactions are known to be catalyzed by small quantities of compounds of the transition metals, such as copper, cobalt and iron. Pradt et al Swedish Utlaggningsskrift No. 73 01518-2, published Aug. 7, 1973, indicate that the rate of delignification of wood using oxygen and alkali could be increased in the presence of a copper salt as a catalyst. It has however been demonstrated (*Svensk Papperstidning* 76 480–485 (1973) that the addition of copper salts using either wood powder or wood chips results in a severe degradation of the cellulose, which in turn gives a lower viscosity of the cellulose at a given lignin content and a given Kappa number (referred to generally as an impaired selectivity).

Mitchell et al U.S. Pat. No. 2,811,518, patented Oct. 29, 1957 utilizes manganese to catalyze the oxidative degradation reactions of cellulose and therefore effect a depolymerization of the cellulose. The cellulose, having been depolymerized and degraded, has such reduced strength that is useless in paper, and Mitchell et al uses it in viscose, not in paper.

By selectivity is meant a favoring of the desirable reactions that are required for delignification, and a suppression of the undesirable reactions that lead to depolymerization and also accompany delignification. The undesirable reactions include depolymerization or degradation of the cellulose. The Mitchell process is thus desirable for the manufacture of depolymerized cellulose pulp, for conversion into alkali cellulose in the viscose process. Such pulps should be depolymerized, as Mitchell explains in the first portion of the patent. This is not only not desirable with paper pulps; it destroys the utility of such pulp for paper manufacture, because of the resulting low strength. Viscose of course is a cellulose solution which required regeneration to fiber form, so it falls in an entirely different category from paper pulp.

While the Mitchell process proceeds without appreciable loss of cellulose, this is *not* true of pulp *yield.* There are several components of a cellulose pulp, all of which contribute to pulp yield. Not only is there cellulose, but there is also hemicellulose. Hemicellulose is a desirable component of paper pulps, but it is not a desirable component of viscose pulps. Consequently, Mitchell obtains a dissolution of hemicellulose. The dissolution of hemicellulose results, as might be expected, in a considerable reduction in yield in the Mitchell process, despite the fact that cellulose is not lost. The reduction in yield occurs because of the dissolution of hemicellulose.

Mitchell et al are concerned with depolymerization in the course of alkaline refining of a delignified bleached pulp, which has already been subjected to delignification in the course of a preliminary digestion and bleaching under oxidizing conditions. The Mitchell et al alkali refining thus takes place at a later stage of the processing than the delignification in paper pulp manufacture.

Mitchell et al asserts that this reaction results in cleavage of the cellulose chains near their middle, because of the use of alkali and oxygen. The alkaline solution contains an amount of alkali equivalent to 0.2 to 6% NaOH in solution, which puts its pH at 13 or over. While it does not require a depolymerization catalyst, oxidation catalysts such as cobalt or manganese can be added, and if they are, the cleavage reactions are enhanced.

Mitchell et al use a very small amount of manganese. In Example 1, Mitchell et al use 10 ppm of manganese based on the cellulose. In Example 2, 5 ppm manganese was used; in Example 3, 1 ppm cobalt, and in Example 4, 0.2 ppm cobalt. In these quantities, manganese evidently functions as a depolymerization catalyst.

Since the pulp that is treated by Mitchell et al has already been substantially completely delignified, having been subjected to a digestion and also to a bleaching, there is a negligible amount of delignification in the course of the Mitchell et al alkali refining. Thus, for instance, in Example 1 a chlorinated sulfite pulp stock is used, which is clearly a bleached pulp, and therefore a pulp stock which has been substantially completely delignified.

Landucci and Sanyer in *TAPPI,* October 1974, pp. 97–100, describe how fiberized loblolly pine was efficiently delignified with oxygen in a single stage at low consistency by using a mildly alkaline system. Selectivity of delignification, rate of delignification, and pulp viscosity were optimized by adjusting variables such as pH, reaction temperature, and buffer type. Adding magnesium ion offered no significant protection to the carbohydrates. Iodide ion gave a large viscosity increase, whereas adding manganous ion resulted in a smaller increase. Both iodide ion and manganous ion increased selectivity. Adding trace amounts of manganous ion also increased the rate of delignification and allowed lower oxygen pressures to be used. A pulp yield of 56% at 5% lignin content favorably compared to Kraft pulp yield of 47%.

Landucci, Minor and Sanyer, *A.B.I.P.C.* Vol. 44, No. 6 (December, 1973), pp. 6155–62, INFLUENCE OF METAL AND IODIDE IONS IN OXYGEN PULPING OF SOUTHERN PINE., Can. Wood Chem. Symp. (Chem. Inst. Can./CCPA, Chateau Frontenac), Extended Abstrs. Papers Presented 4:71-4 (July 4–6, 1973) describe how fiberized southern pine was rapidly and efficiently delignified with molecular oxygen in a single-stage mildly alkaline medium. Optimum conditions of temperature, pH, oxygen pressure, and buffer type (borate, carbonate, acetate, phosphate) for maximum pulp yield were established. Yield differences among buffer systems were small; borate appeared slightly superior to the others. However, delignification rates varied considerably; relative rates at constant pH (cold) were 1.0 for borate, 0.7 for carbonate, 0.5 for acetate, and 0.4 for phosphate. Neither pulp yield nor pulping rate was significantly altered at liquor:wood ratios from 16 to 100. Yield increased to a maximum with increased concentration (pressure) of oxygen in the liquor; the position of the maximum plateau depended on temperature and pH. Optimum yields above pH 9 were unattainable at 140°–170° C. The delignification rate followed pseudo-1st-order kinetics. No significant variations in pulp viscosity (indicative of carbohydrate damage) were evident between pH 7–9 and 140°–160° C. Adding magnesium gave little protection to the carbohydrates, even when the fibers were pretreated with solution magnesium gluconate. Iodide achieved significant stabilization, as evident by 3- and 4-fold increases of viscosity (over uniodized controls) at pH 9 and 7, respectively. The addition of manganese to the pulping mixture gave a minor yield increase, but nearly doubled the delignification rate.

There is no reference in either paper to the pretreatment of the lignocellulose material to remove metal ions and compounds such as copper, cobalt and iron.

In accordance with the invention, it has now been determined that both the rate and the selectivity of the delignification in the presence of manganese can be improved, if the lignocellulose material prior to the oxygen-alkali delignification is treated so as to remove at least a major proportion and preferably substantially all of the catalytically active metal ion or compounds that may be present with the material, such as copper, iron and cobalt.

Such removal enhances the catalytic activity of the manganese compounds in the course of delignification, and results in a synergistic retarding effect of the added manganese on the depolymerization of the cellulose. Surprisingly, the removal even of manganese present with the lignocellulosic material ab initio in the course of such a pretreatment improves the selectivity and catalytic effect of manganese compounds added subsequently, and prior to or at an early stage of the oxygen-alkali delignification.

Then, following the pretreatment, the lignocellulosic material is delignified by oxygen and alkali in the presence of catalytically-active manganese compounds. The manganese compounds should be added after the pretreatment, but prior to the start of the delignification, or at an early stage of the delignification, and before dissolution of approximately 10% of the lignin content of the starting lignocellulosic material.

Some types of lignocellulosic material contain manganese compounds. At least a proportion of such manganese compounds apparently is locked in, in an inactive noncatalytic form, however, unable to catalyze delignification to a noticeable extent. The delignification of such manganese-containing lignocellulosic material is also improved, in accordance with the invention, by first removing such manganese as can be removed by dissolution in the pretreatment, and then adding catalytically active manganese compounds, i.e. manganese compounds capable of supplying manganese to the delignification reaction in a catalytic form, in which possibly manganese ion is provided in solution in the alkaline delignification liquor in an active condition. Such added manganese in active form catalyzes the delignification, increasing the rate of delignification, and improves selectivity, as shown by a higher viscosity at a given Kappa number of the resulting pulp, whether bleached or unbleached.

The manganese compound can be added prior to the delignification in a sufficient amount, or incrementally or continuously in the course of the delignification, together with or separately from incrementally or continuously added alkali. Such supplemental addition of manganese may be desirable in order to maintain a suitable concentration of active manganese compounds throughout the delignification.

It is also suitable to carry out the delignification in one or more stages, at varying pH's in the course of each stage, and active manganese compounds can be added to the delignification reaction mixture in one, or several, or all of these stages.

In the pretreatment process of the invention, the lignocellulosic material is subjected to treatment with water and/or an aqueous solution in one or more stages so as to remove metal ions or compounds thereof such as copper, cobalt and iron, and also manganese and any other metal ions which may be present. The pretreatment is especially advantageous in the case of hardwood chips.

Such metal ions or compounds have a deleterious effect upon the delignification, and may also increase attack on the carbohydrates in the course of the delignification, due to a catalytic effect on the degradation reactions. Frequently, when such metal ions or compounds are allowed to remain during the delignification process of the invention, the result is a lower viscosity in the treated pulp, or a lower carbohydrate content thereof, or both, either or both of which may well be undesirable.

The pretreatment accordingly is carried out under conditions such that these metal ions or compounds are removed by dissolution in the treating liquor.

It is frequently possible to remove all or part of such metal ions or compounds by washing the lignocellulosic material with water. This results in the removal of water-soluble metal compounds by leaching or dissolution. An improved dissolution is obtained at elevated temperatures. The longer the washing time, the greater the proportion of metal ions or compounds that are extracted.

A suitable washing treatment is carried out using hot water at a temperature within the range from about 90° to about 160° C for from 0.1 to about 10 hours. In the course of the heat treatment in the presence of water, some of the lignocellulosic material is hyrolyzed to give organic acids which dissolve in the solution, for example, acetic acid, and the resulting acid solution has an improved capacity for dissolution of metal ions and compounds present in the lignocellulosic material.

Aqueous acidic solutions containing organic and inorganic acids can also be used, such as acetic acid, citric acid, formic acid, hydrochloric acid, sulphuric acid, nitric acid, phosphoric acid and sulphurous acid. Such solutions can have a pH within the range from about 1 to about 5, suitably from about 1.5 to about 4, and preferably from about 2 to about 3.5, with the contact continued for from about 0.1 to about 10 hours. Treatment with acidic aqueous solutions can be carried out at ambient temperatures, i.e., from about 10° to about 30° C, but elevated temperatures can also be used, ranging from about 40° to about 140° C. In the case of raw lignocellulosic materials, such as wood, such a treatment may be accompanied by hydrolysis of the cellulose, with the formation of additional acids.

However, when the delignification process of the invention is applied to paper pulp, it is important to avoid hydrolysis of the cellulose. In such cases, the time and temperature of the treatment together with the pH should be adjusted so that the depolymerization of the carbohydrate material in the pulp is either entirely avoided or at least kept to a minimum.

With certain raw lignocellulosic materials, and particularly wood in particulate form, especially hardwood, it has been found advantageous to carry out the pretreatment with an aqueous alkaline solution, such as an alkali metal hydroxide or alkali metal carbonate or bicarbonate solution, for example, sodium hydroxide, sodium carbonate and sodium bicarbonate solution, the alkaline hydroxides or salts being used singly or in admixture.

Such an alkaline treatment is carried out preferably at an elevated temperature within the range from about 100° to about 200° C, suitably from about 120° to about 190° C, and preferably from about 140° to about 180° C, until there has been dissolved in the solution an amount of lignocellulosic material within the range from about 2 to about 40% by weight, suitably from about 5 to about 30% by weight, and preferably from about 5 to about 20% by weight, based on the dry weight of the lignocellulosic material. The treatment time can be within the range from about 0.1 to about 10 hours, suitably from about 0.25 to about 4 hours, and preferably from about 0.5 to about 2 hours.

Any carbon dioxide formed during the treatment is preferably vented, either continuously or from time to time.

Chelating or complexing agents for the metal ions to be removed can also be present. Such solutions have a superior extracting effect for the metal content of the lignocellulosic material. Any chelating acids can be used.

Aliphatic alpha-hydroxycarboxylic acids of the type RCHOHCOOH and the corresponding beta-hydroxycarboxylic acids $RCHOHCH_2COOH$ have the property of forming chelates with catalytically active metals.

Exemplary alpha- and beta-hydroxy carboxylic acids are glycolic acid, lactic acid, glyceric acid, α,β-dihydroxybutyric acid, α-hydroxybutyric acid, α-hydroxyisobutyric acid, α-hydroxy-n-valeric acid, α-hydroxyisovaleric acid, β-hydroxyisobutyric acid, β-hydroxyisovaleric acid, erythronic acid, threonic acid, trihydroxyisobutyric acid, and sugar acids and aldonic acids, such as gluconic acid, galactonic acid, talonic acid, mannonic acid, arabonic acid, ribonic acid, xylonic acid, lyxonic acid, gulonic acid, idonic acid, altronic acid, allonic acid, ethenyl glycolic acid, and β-hydroxyisocrotonic acid.

Also useful are organic acids having two or more carboxylic groups, and no or from one to 10 hydroxyl groups, such as oxalic acid, malonic acid, tartaric acid, malic acid, and citric acid, ethyl malonic acid, succinic acid, isosuccinic acid, glutaric acid, adipic acid, suberic acid, azelaic acid, maleic acid, fumaric acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

Aminopolycarboxylic acids can be used, especially those having the general formula

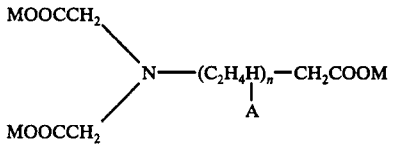

in which A is $CH_2COOH$ or $CH_2CH_2OH$ and $n$ is a number within the range from 0 to 5, and M is hydrogen, an alkali metal or ammonium.

Suitable chelating acids include ethylene-diamine tetraacetic acid, nitrilotriacetic acid and diethylene triaminepentaacetic acid, as well as amines, particularly hydroxy alkyl amines such as mono-, di-, and triethanolamine, and diamines, triamines and higher polyamines having complexing properties. Mixtures of these complexing and chelating agents can also be used, especially combinations of chelating agents that contain nitrogen with chelating agents that do not contain nitrogen.

Also useful are the polyphosphoric acids and their salts, such as pentasodium tripolyphosphate, tetrasodium pyrophosphate, and sodium hexametaphosphate.

Particularly useful are the metal complexing agents present in waste cellulose pulping, cellulose bleaching and other cellulose processing liquors, which may be either alkaline or acidic. Such liquors normally contain complexing agents derived from the cellulose, as well as the complexing agents added for the purpose of the cellulose process from which the waste liquor is obtained.

Suitable waste liquors are for example waste pulping liquors, especially those from oxygen alkali pulping processes, and waste bleaching liquors, especially those from oxygen-alkali bleaching processes. Particularly advantageous are liquors from oyxgen-alkali delignification processes that contain complexing agents for cellulose degradation inhibitors. Used wash water from cellulose treatment processes also can be employed, including wash waters previously used for the pretreatment of earlier batches of lignocellulosic material treated by the process of the invention, as well as waste liquors from the delignification process of the invention.

Pretreatment liquors of different types can advantageously be combined or applied in sequence, as desired, for the greatest possible beneficial effect from different types of liquors. Thus, for example, in a first step a pretreatment may be effected with water containing dissolved sulphur dioxide having a pH of 2, at a temperature of 20° C, followed by treatment with an aqueous solution of sodium bicarbonate and sodium carbonate in the ratio of 7:3 (20% per weight based on dry wood) at 160° C for two hours in the presence of 0.1% diethylenetriamine pentaacetic acid, based on the dry weight of the lignocellulosic material.

Air may be injected into the pretreatment liquor under pressure; oxygen may also be introduced.

After the pretreatment, it is desirable to wash the lignocellulosic material prior to the oxygen-alkali delignification process of the invention. Such washing of a pretreated lignocellulosic material makes it possible to remove not only residual traces of metal ions or compounds but also traces of the pretreatment liquor. The wash waters from this step can be returned to the pretreatment step.

The added manganese compounds employed in the process of the invention provide manganese in catalytically active form to the delignification. For this purpose, the manganese should be preferably in a form which provides bivalent manganese. The anion with which the added manganese is associated can be inorganic or organic, and the added manganese can also be associated in a complex which provides a proportion of manganese.

Exemplary bivalent manganese compounds include manganous oxide, manganous chloride, manganous bromide, manganous hydroxide, manganous nitrate, manganous sulfate, manganous carbonate, manganous phosphate, manganous chlorate, manganous acetate, manganous formate, manganous oxalate, and complex salts of manganous ion with chelating inorganic and organic acids.

Aliphatic alpha-hydroxycarboxylic acids of the type RCHOHCOOH and the corresponding beta-hydroxycarboxylic acids $RCHOHCH_2COOH$ have the property of forming chelates with manganese.

Exemplary alpha- and beta-hydroxy carboxylic acids are glycolic acid, lactic acid, glyceric acid, α, β-dihydroxybutyric acid, α-hydroxybutyric acid, α-hydroxyisobutyric acid, α-hydroxy-n-valeric acid, α-hydroxyisovaleric acid, β-hydroxyisobutyric acid, β-hydroxyisovaleric acid, erythronic acid, threonic acid, trihydroxyisobutyric acid, and sugar acids and aldonic acids, such as gluconic acid, galactonic acid, talonic acid, mannonic acid, arabonic acid, ribonic acid, xylonic acid, lyxonic acid, gulonic acid, idonic acid, altronic acid, allonic acid, ethenyl glycolic acid, and β-hydroxyisocrotonic acid.

Also useful are organic acids having two or more carboxylic groups, and no or from one to ten hydroxyl groups, such as oxalic acid, malonic acid, tartaric acid, malic acid, and citric acid, ethyl malonic acid, succinic acid, isosuccinic acid, glutaric acid, adipic acid, suberic acid, azelaic acid, maleic acid, fumaric acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

Manganese complexes of nitrogen-containing polycarboxylic acids are especially effective inhibitors. Several important acids belonging to this group have the formula:

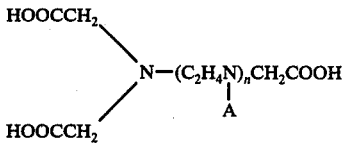

or alkali metal salts thereof, in which A is the group—$CH_2COOH$ or —$CH_2CH_2OH$, where $n$ is an integer from zero to five. The mono, di, tri, tetra, penta and higher alkali metal salts are useful, according to the available carboxylic acid groups converted to alkali metal salt form.

Examples of such compounds are ethylene diamine tetraacetic acid, ethylene diamine triacetic acid, nitrilotriacetic acid, diethylene-triaminopentaacetic acid, tetraethylenepentamine heptaacetic acid, and hydroxyethylene diamine triacetic acid, and their alkali metal salts, including the mono, di, tri, tetra and penta sodium, potassium and lithium salts thereof. Other types of aminocarboxylic acids which can be used to advantage are iminodiacetic acid, 2-hydroxyethyliminodiacetic acid, cyclohexanediamine tetraacetic acid, anthranil-N,N-diacetic acid, and 2-picolylamine -N,N-diacetic acid.

These complexing agents can be present in rather large quantities, within the range from about two to about ten times the amount needed to prevent precipitation of manganese compounds during the impregnation of the lignocellulosic material with manganese. The use of waste pulping or bleaching liquor in combination with complexing agents of this type is particularly advantageous.

The polyphosphoric acids are also good complexing agents for manganese, and the manganese salts of these acids are useful in the process of the invention. Exemplary are disodium manganous pyrophosphate, trisodium manganous tripolyphosphate and manganous polymetaphosphate.

Especially advantageous from the standpoint of cost are the acids naturally present in waste liquors obtained from the alkaline treatment of cellulosic materials. These acids represent the alkali- or water-soluble degradation products of polysaccarides which are dissolved in such liquors, as well as alkali- or water-soluble degradation products of cellulose and hemicellulose. The chemical nature of these degradation products are complex, and they have not been fully identified. However, it is known that saccharinic and lactic acids are present in such liquors, and that other hydroxy acids are also present. The presence of $C_6$-isosaccharinic and $C_6$-metasaccharinic acids has been demonstrated, as well as $C_4$- and $C_5$ metasaccharinic acids. Glycolic acid and lactic acid are also probable degradation products derived from the hemicelluloses, together with beta-gamma-dihydroxy butyric acid.

Carbohydrate acid-containing cellulose waste liquors which can be used include the liquors obtained from the hot alkali treatment of cellulose; liquors from sulfite digestion processes; and liquors from sulfate digestion processes, i.e., Kraft waste liquor. The waste liquors obtained in alkaline oxygen gas bleaching processes, for example, those disclosed in U.S. Pats. Nos. 3,652,385 and 3,652,386, or alkaline peroxide bleaching processes can also be used. In this instance, the alkaline liquor can be taken out from the process subsequent to completing the oxygen gas delignification or during the actual delignification process.

The complex manganese salts can be formed first, and then added to the lignocellulosic material. They can also be formed in situ from a water-soluble and water-insoluble manganous salt, oxide or hydroxide, in admixture with the complexing acid, and this mixture can be added to the lignocellulosic material. Preferably, the waste liquor employed as the source of complexing acid or lactone or salt thereof can be mixed with a manganous salt, oxide or hydroxide, before being introduced to the process. It is also possible to add the manganous salt, oxide or hydroxide to the delignificationn liquor, and then bring the liquor into contact with the complexing acid or lactone or salt thereof. It is also possible to combine the complexing acid or lactone or salt thereof with hydroxide, liquor and then add the manganous salt, oxide or hydroxicde, but this method may be less advantageous in practice.

Manganese compounds providing manganese ion in a higher valence state, such as trivalent or tetravalent manganese, can be used, but may lead to the production of pulp having an impaired brightness. Exemplary higher polyvalent manganese compounds include manganic chloride, manganic nitrite, manganic sulfate, manganic carbonate, manganic acetate, manganic formate and manganic oxalate, and complex salts of manganic ion with any of the chelating acids mentioned above.

It is not understood why the addition of manganese has a different effect upon the course of the delignification than manganese which is already present in the lignocellulosic material. According to the available evidence, best results are obtained when a water-soluble manganous salt is impregnated into the wood or cellulose pulp, before delignification, with oxygen and alkali.

It has not been possible to determine the form of catalytic manganese present in the delignification reaction system, nor has it been possible to distinguish between active manganese and inactive manganese in this system by analytical methods. For this reason, analysis of the lignocellulosic material for manganese content is not revealing. All that is known is that the manganese must be added in a catalytic form, and that it should be freshly added, for optimum effect. Consequently, throughout the specification and claims, reference to manganese in active form or in catalytic form is a reference to such manganese compounds.

In whatever form manganese is added, whether as salt, oxide, hydroxide, or complex salt, the amount of manganese is calculated as Mn.

The quantity of manganese compounds added to the system is selected according to the nature of the starting material, and the desired quality of the delignified product.

Amounts within the range from about 0.01 to about 1% by weight of the dry lignocellulosic material give good results. Beneficial effects may be observed at 0.001% by weight of the dry lignocellulosic material. Optimum results have been obtained at amounts within the range from about 0.05 to 0.5%. Amounts in excess of 1% up to 2% may not afford any better effect under normal conditions, and may result in an impaired brightness, but such amounts can be used.

The oxygen-alkali delignification process in accordance with the invention is applicable to the delignification of any kind of lignocellulosic material, such as bagasse, straw, jute, and particularly wood.

The delignification process of the invention is applicable to any kind of wood. In general, hardwood such as beech and oak can be pulped more easily than softwood, such as spruce and pine, but both types of wood can be pulped satisfactorily using this process. Exemplary hardwoods which can be pulped include birch, beech, poplar, cherry, sycamore, hickory, ash, oak, chestnut, aspen, maple, alder and eucalyptus. Exemplary softwoods include spruce, fir, pine, cedar, juniper and hemlock.

The lignocellulosic material should be in particulate form. Wood chips having dimensions that are conventionally employed in the oxygen-alkali pulping process can be used. However, appreciable advantages with respect to uniformity of the delignification process under all kinds of reaction conditions can be obtained if the wood is in the form of nonuniform fragments of the type of wood shavings or chips having an average thickness of at most 3 mm, and preferably within the range from about 0.2 to 2 mm. Other dimensions are not critical. Sawdust, wood flour, wood slivers and splinters, wood granules, and wood chunks, and other types of wood fragments can also be used.

The oxygen-alkali delignification process in accordance with the invention is also applicable to the delignification of unbleached cellulose pulp. The process can be used to advantage with wood pulp of any type, including mechanical pulp, but particularly chemical pulp and semichemical pulp. The chemical pulp can be prepared by any pulping process. Oxygen-alkali pulp, sulfate pulp and sulfite pulp are illustrative. The invention is applicable to cellulose pulps derived from any type of wood, such as spruce pulp, pine pulp, hemlock pulp, birch pulp, cherry pulp, sycamore pulp, hickory pulp, ash pulp, beech pulp, poplar pulp, oak pulp and chestnut pulp.

The delignification process of the invention can also be carried out in conjunction with the oxygen delignification of, for example, defibrated wood, and wood which has first been subjected to a chemical treatment, for example a soda cooking operation, and subsequently defiberized. This latter method is sometimes referred to as an oxygen cooking process, although the oxygen bleaching of semi-chemical pulp is a better designation. Normally, an oxygen delignification process is continued, even when concerned with an oxygen cooking process, until the material is readily defiberized. Shives separated after the cooking and uncooked material can be returned to the process, or treated separately in accordance with known methods.

The conditions under which the oxygen-alkali delignification process of the invention is carried out in the presence of catalytically active manganese are selected to accommodate the lignocellulosic material being treated and the purposes for which its treatment product is to be used. Since the process is applicable both to raw lignocellulosic material and to pulped lignocellulosic material, which are chemically and physically quite different and nonequivalent materials, different delignification conditions may be desirable.

The delignification in the presence of added manganese compounds in accordance with the invention can be carried out at a pH within the range from about 6.5 to about 11, and preferably within the range from about 7 to about 10. Optimum results are obtained if the pH is held within the range from about 7 to about 9.5 during the major part of the delignification.

It is important that pH be determined by measurements on a delignification liquor at ambient temperature i.e., from 10 to 30° C. Consequently, if the pH of a hot delignification liquor is to be determined, the liquor is cooled to ambient temperature before such pH determination. This is necessary in order to obtain accurate and reproductible pH measurements.

The total amount of alkali that is required for the delignification is determined by the quality and type of the pulp to be produced and is within the range from about 1 to 10 kilomoles per 1,000 kg. of dry wood. Cellulose pulps intended to be used in the production of regenerated cellulose fibers, such as viscose, acetate and cuprammonium pulps, are quite fully delignified, and should have a low content of lignin and hemicellulose. In the production of such pulps, in accordance with the process of the invention, the amount of alkali can be within the range from about 6 to about 8 kilomoles per 1,000 kg. of dry wood. Semichemical pulps are given an intensive mechanical treatment following their digestion in order to liberate the cellulose fibers, and in the production of such pulps, using the process of the invention, the amount of alkali can be much less, within the range from about 1 to about 2 kilomoles per 1,000 kg. of dry wood. For the production of bright paper pulp, which is readily defibered when the digester is blown, the amount of alkali used in the process of the invention can be within the range from about 2.5 to about 5 kilomoles. Generally, for most of the types of pulps given an intermediate degree of digestion, such as pulps for fine paper, plastic fillers, and soft paper or tissue paper, the amount of alkali in the process of the invention is within the range from about 2 to about 6 kilomoles per 1,000 kg. of dry wood.

Any alkali metal hydroxide or alkali metal carbonate can be employed, such as sodium hydroxide, potassium hydroxide, lithium hydroxide, sodium carbonate, potassium carbonate and lithium carbonate. The sodium carbonate obtained in the burning of cellulose digestion waste liquors can be used for this purpose. The use of alkali metal carbonates may be more advantageous than the use of alkali metal hydroxides in maintaining the pH of the delignification liquor within the stated range, because of the buffering properties of the carbonate or bicarbonate present or formed in situ. Consequently, mixtures of alkali metal hydroxides and alkali metal carbonates are particularly satisfactory to obtain the advantages of each, and dilute their disadvantages. However, if alkali metal carbonate such as sodium carbonate is the sole alkali charge, the total amount of sodium is greater, and this imposes a greater load on the sodium recovery system.

The pH range employed in the delignification process of the invention is considerably below the pH range used when sodium hydroxide is used as the active alkali. The pH range in accordance with the invention is therefore obtained using as the alkali an appropriate mixture of alkali metal carbonate and/or bicarbonate, either or both which may be admixed with alkali metal hydroxide in a minor proportion, to give a pH within the stated range. It is thus possible to use mixtures with alkali metal hydroxides or carbonates with alkali metal bicarbonates such as sodium bicarbonate and potassium bicarbonate. The alkali metal bicarbonate in the case serves as a buffer. Other buffering agents, compounds of alkali metals with nondeleterious acidic anions, can be employed, such as alkali metal acid phosphates, such as potassium dihydrogen phosphate, potassium monohydrogen phosphate, sodium dihydrogen phosphate, potassium monohydrogen phosphate, sodium dihydrogen phosphate, sodium monohydrogen phosphate, as well as the lithium salts of these anions.

The amount of buffering agent such as alkali metal bicarbonate is usually within the range from about 1 to about 5 kilomoles per 1,000 kg. of drywood. The alkali metal bicarbonate or other buffering agent should be added to the delignification liquor either initially or at an early stage of the delignification. The addition of the bicarbonate or other buffering agent increases the buffer capacity of the delignification liquor, thereby assisting in avoiding variations in pH outside the prescribed range during the delignification.

Large amounts of buffering agents, and particularly bicarbonates, should be avoided, however, since the presence of large amounts of additional foreign anions can be undesirable. In the case of bicarbonates, carbon dioxide may be produced in the course of the delignification as the buffer is consumed. The carbon dioxide dilutes the oxygen, and adds an extra load to the chemical recovery system, and is therefore undesirable in large amounts. However, the addition of minor amounts of the buffering agent within the stated range contribute to pulp uniformity because of their assistance in maintaining pH.

Also useful as a buffer are the base liquors from previous digestions and/or the waste liquors from oxygen bleaching processes, such as those described in U.S. Pat. Nos. 3,652,385 and 3,652,386. In this way, better economy is obtained in chemical recovery, which can be effected after evaporating and burning the waste digestion liquor, using known methods.

For economic reasons, the sodium compounds are preferred as the alkali metal hydroxide, alkali metal carbonate and alkali metal bicarbonate.

It is also possible to add the additional chemicals normally present in digestion liquors, such as sodium sulfide or other alkali metal sulfide. At most, such chemicals are added in an amount of about 1 kilomole per 1,000 kg. of dry wood.

Limiting the amount of alkali metal hydroxide and/or alkali metal carbonate in the initial stages of the process may be quite advantageous in obtaining a cellulose pulp of the desired quality. At most, 75 percent of the total molar quantity required of the alkali can be added ab initio, and even this high percentage is only desirable if the pulp to be manufactured is a semichemical pulp, or if the wood has been pretreated with sulfur dioxide in aqueous solution. For most pulps, including even the semichemical pulps, a better cellulose pulp is obtained if the initial charge of alkali is within the range from about 2 to about 50 percent of the total molar quantity required for the delignification. The remainder of the alkali is added progressively, either incrementally or continuously, as the delignification continues. When producing bright pulps having a low lignin content, it is satisfactory to charge not more than 20 percent and suitably from about 5 to about 20 percent of the alkali at the beginning of the delignification process.

If a mixture of alkali metal hydroxide and alkali metal carbonate is used, it is particularly suitable if the initial charge comprises sodium carbonate, optionally with an addition of sodium bicarbonate as described above, the remainder of the alkali added as the delignification proceeds being sodium hydroxide. If the alkali charge initially is alkali metal hydroxide, it is usually important in producing pulps having a low lignin content that the initial charge be low, within the range from about 2 to about 10 percent, of the total molar quantity of alkali.

Whether or not the delignification process is carried out continuously or as a batch process, the alkali metal hydroxide and/or alkali metal carbonate can be charged continuously or in increments to the delignification liquor. In a continuous delignification, the wood is caused to move through the reactor from one end to the other which thereby constitutes a reaction zone. In a batch process, the wood, usually in the form of chips, is retained in the reaction vessel throughout the delignification.

Since the oxygen that is employed is an essential component in the delignification process of the invention is a gas, the so-called gas phase digestion procedure can be used to advantage. In this case, the wood and the film of delignification liquor present on the wood are kept in continuous contact with the oxygen-containing gas. If the wood is completely or substantially immersed in the delignification liquor, it is important to agitate the wood and/or the gas and/or atomize the gas or the liquor. The oxygen should be dissolved or dispersed in the delignification liquor to the greatest extent possible. Dissolution or dispersion of the oxygen in the liquor can take place within the reactor and/or externally of the same, such as in nozzles, containers or other known devices used for dissolving or dispersing gases in liquids.

In application to wood in chip form, the cooking liquor can be allowed to run continuously or intermittently over the chips during the delignification process. In the case of pulped lignocellulosic material with the fibres exposed, such as chemical pulp such as sulphate pulp, semi-chemical or mechanical pulp, one can impregnate the pulp with a solution containing active alkali, remove excess solution, by draining and/or pressing operations, and then subject the pulp to the delignification process.

The method can also be applied to a slurry of the lignocellulosic material in the delignification liquid, while the material is in intimate contact with oxygen under pressure.

Transfer of oxygen to the delignification material impregnated with delignification liquor is important in the process, and is controlled by adjusting the oxygen pressure, the delignification temperature and/or the proportion of gas-liquid contact surfaces, including the wood impregnated with delignification liquor.

The oxygen is preferably employed as pure oxygen, but mixtures of oxygen with other inert gases can be used, such as, for example, mixtures of oxygen with nitrogen and with carbon dioxide and with both, as well as air. Compressed air can also be used, although this complicates the devices for dissolving or dispersing the oxygen in the reaction mixture.

The partial pressure of oxygen can be as low as 1 bar, although under normal conditions it is most advantageous to use a pressure of at least 5 bars. When the method is applied to non-defibrated wood chips or similar types of wood fragments, e.g. sticks or shavings or sliced wood chips, it is suitable to maintain an oxygen pressure of at least 10 bars. A strong reduction in the shive content and an improvement in the selectivity is obtained at higher oxygen pressures, such as pressures within the range from about 12 to about 100 bars. The best results at reasonable apparatus costs are obtained within the range from about 20 to about 40 bars, within which range the shive content is surprisingly low in comparison with parallel tests at 5 bars pressure.

During the major part of the oxygen-alkali delignification process, the temperature should be maintained within the range from about 100° to about 170° C. At temperatures within the range of from 100° to 120° C., the reaction is slow. The preferred temperature range is from about 120° to 160° C, still more preferably from about 120° to about 150° C. A temperature from 120° to 140° C is particularly suitable for the treatment of lignocellulosic material having a low lignin content, e.g. wood cellulose of the sulphate pulp type, while a temperature from 130° to 150° C is particularly suitable for wood chips and other wood fragments with a retained wood structure.

Pulps for a certain field of use, for example, for use in the production of paper, should have a high degree of strength. In such cases, it is suitable to carry out the delignification in the presence of an inhibitor or mixture of inhibitors which protect the cellulose and hemicellulose molecules against uncontrolled degradation. The effect of the inhibitors is reflected by the viscosity of the pulp, and the degree of polymerization of the cellulose.

The inhibitors can to advantage be charged to the delignification liquor during an early stage of the delignification or, preferably, at the beginning, before the delignification heating is begun. Thus, they can be added to the delignification liquor before combination with the wood, or shortly thereafter. Suitable inhibitors are water-insoluble magnesium compounds, such as magnesium carbonate. Magnesium carbonate is known, and is disclosed in U.S. Pat. No. 3,384,533 to Robert et al. dated May 21, 1968 as useful in the delignification and bleaching of cellulose pulps with alkali and oxygen, but this is not a digestion of wood. Other water-insoluble magnesium compounds such as magnesium oxide and hydroxide are disclosed in South African Pat. No. 3771/68 to L'Air Liquide, also relating to alkaline oxygen bleaching of cellulose pulps. Also useful are water-soluble magnesium compounds such as magnesium chloride or magnesium acetate, which form water-insoluble magnesium compounds in the alkaline digestion liquor such as magnesium hydroxide or magnesium carbonate, and therefore exist as such insoluble compounds after the digestion. These are also disclosed in South African Pat. No. 3771/68. However, magnesium compounds which are soluble in the digestion liquor in the course of the digestion process are preferred. Such water-soluble magnesium compounds are disclosed in U.S. Pat. Nos. 3,652,385 and 3,652,386, both patented Mar. 28, 1972, the disclosures of which are hereby incorporated by reference.

After the oxygen delignification process has been completed, the pulp may optionally be subjected to a mechanical treatment in order to liberate the fibers. If the pulping is brief or moderate, a defibrator, disintegrator, or shredder may be appropriate. After an extensive or more complete pulping or delignification, the wood can be defibrated in the same manner as in other conventional cellulose cooking processes, such as sulfate pulping, by blowing off the material from the digester, or by pumping.

The pulped wood cellulose that is obtained in accordance with the process of the invention is of such whiteness that it can be used to advantage directly for producing tissue paper, light cardboard and magazine paper. When a higher degree of brightness is desired, as for fine paper, rayon and cellulose derivatives, the pulp can easily be bleached in accordance with known methods by treatment with chlorine, chlorine dioxide, chlorite, hypochlorite, peroxide, peracetate, oxygen or any combinations of these bleaching agents in one or more bleaching sequence as described in for example U.S. application Ser. No. 882,812, now U.S. Pat. No. 3,652,388. Chlorine dioxide has been found to be a particularly suitable bleaching agent for the oxygen digested cellulose pulp obtained in accordance with this invention. The consumption of bleaching chemicals is generally markedly lower in bleaching oxygen digested pulps of the invention than when bleaching sulfate cellulose.

The chemicals used for the digestion process can be recovered after the waste liquor is burned and subsequent to optionally causticizing all or part of the carbonate obtained when burning the liquor.

Preferred embodiments of the delignification process of the invention and of the cellulose pulps of the invention are shown in the following Examples:

EXAMPLE 1

Sawdust from birch wood was first pretreated to remove metal ions by soaking in five parts of $SO_2$ water having a pH of 3 at 20° C for ten minutes. The resulting solution contained copper, manganese, iron, magnesium, calcium and sodium ions, and was allowed to drain off. The dissolution pretreatment operation was repeated twice. The pretreated powder was then washed with water, and divided into two equal portions.

The first portion (Control A) was subjected to an oxygen-alkali delignification process at an oxygen partial pressure of 21 bars and a temperature of 135° C, with sodium bicarbonate as the alkali. In order to eliminate mass transfer problems and interference by trace metals, the process was effected at a low wood-to-liquid ratio (8:700) and with pure oxygen, which was caused to bubble through the Teflon-lined reactor, and a low initial concentration of $NaHCO_3$ (0.05 mol/liter). The tests were carried out at different delignification times. The pulp was filtered off after termination of the treatment process. The Kappa number according to SCAN was used to determine the lignin content. The intrinsic viscosity was determined according to SCAN.

The second portion (Example 1) of the pretreated birch sawdust was treated in the same manner, but in accordance with the invention with an addition of manganous chloride corresponding to a charge of 0.1% Mn based on the dry weight of the wood powder. The addition was made to the aqueous sodium bicarbonate solution before beginning the oxygen-alkali delignification.

For comparison purposes, the results obtained with a second control (Control B) using the same birch sawdust without pretreatment and without an addition of manganese are also given, as well as the results obtained with a third control (Control C), without pretreatment but with an addition of manganese of 0.1% Mn, as manganous chloride, as in Example 1.

In all tests, the pH at the end of the process was within the range 9.1 - 9.2, the pH being measured after rapidly cooling to room temperature.

The results shown in the Table below illustrate that the delignification takes place more slowly in the case of pretreated wood than with untreated wood, and that the depolymerization of the cellulose (decrease in viscosity) is not inhibited by the pretreatment with $SO_2$ water.

By adding a manganous salt in accordance with the invention, the delignification rate is increased, so that it is only insignificantly lower than that obtained with unleached sawdust. In spite of this, a markedly higher viscosity was obtained, compared at the same delignification time and also at the same Kappa number, than in Controls A and B, without the addition of manganese, and in Control C, with the addition of manganese and without the pretreatment.

TABLE I

| | Reaction Time (Hours) | Kappa Number | Viscosity $cm^3/g$ |
|---|---|---|---|
| Control A, with pretreatment, but without manganese | 7 | 42.4 | 892 |
| | 9 | 31.3 | 843 |
| | 11 | 21.5 | 774 |
| Control B, without pretreatment, and without manganese | 5 | 39.4 | 968 |
| | 7 | 21.1 | 892 |
| | 9 | 15.2 | 876 |
| Control C, without pretreatment, but in the presence of manganese | 5 | 39.7 | 969 |
| | 7 | 20.7 | 898 |
| | 9 | 14.9 | 882 |
| Example 1, with pretreatment and in the presence of manganese | 7 | 24.0 | 965 |
| | 9 | 17.6 | 954 |
| | 11 | 12.7 | 909 |

EXAMPLE 2

Unbleached birch sulphate pulp having a Kappa number of 20.2 and a viscosity of 1236 $cm^3/g$ was subjected to a pretreatment to remove metal ions using ethylene diamine tetraacetic acid (EDTA), Na-salt, at room temperature for 15 minutes. The pulp concentration was 3%, and the quantity of EDTA charged to the system was 0.2% by weight based on the dry weight of the pulp. The pulp was then washed and impregnated with an aqueous solution containing different quantities of manganous sulphate.

The excess solution was removed by pressing, and an aqueous sodium bicarbonate solution containing 100 g $NaHCO_3$ per liter was admixed with the pulp so that the pulp consistency was 26% and the quantity of bicarbonate corresponded to 5% by weight $NaHCO_3$ based on the dry weight of the pulp.

The quantity of added manganese was calculated by analysing the removed excess solution, and determined to be 2.5, 32 and 320 mg Mn per kg.

The pulp was delignified (bleached) with oxygen at 120° C in three different test series. The duration of this treatment was between 20 and 90 minutes. The total partial pressure of oxygen was seven bars.

The viscosity according to SCAN was studied as a function of the Kappa number.

With a Kappa number of 13, the viscosity was 1130 to 1150 $cm^3/g$, in runs with manganese, while the control without manganese had a viscosity of 1090 $cm^3/g$, and the control without the pretreatment but with manganese had a viscosity of 1040 $cm^3/g$.

With a Kappa number of 11, corresponding viscosities were 1080 - 1090 $cm^3/g$ in the presence of manganese, and 1020 $cm^3/g$ for the control without manganese, and the control without the pretreatment but with manganese had a viscosity of 1010 $cm^3/g$.

At a Kappa number of 9, the viscosities were 980 to 990 $cm^3/g$ with manganese and 890 $cm^3/g$ without manganese, and the control without the pretreatment but with the manganese had a viscosity of 880 $cm^3/g$.

These results show that the selectivity is greatly improved when there is a pretreatment, and manganese is present in accordance with the invention. Further, in this case the effect is not significantly influenced by the magnitude of the manganese addition. The manganese obviously is more important, the longer the bleaching process is continued.

EXAMPLE 3

Industrial birch chips were pretreated to remove metal ions by heating at 160° C with an aqueous solution of $NaHCO_3$ at a wood:liquor ratio of 1:5 for 2 hours. The bicarbonate solution contained EDTA (Na-salt). The $NaHCO_3$ charge corresponded to 20% by weight, and the EDTA to 0.1% by weight, both based on the dry weight of the wood.

The oxygen cooking process was effected at a partial pressure of oxygen of 21 bars by means of a spraying method, aqueous sodium bicarbonate solution being circulated over the pretreated chips for four hours at 140° C. The wood:liquor ratio was 1:14. At the commencement of the cooking operation the bicarbonate charge was 2.1% $NaHCO_3$ based on the dry weight of the wood. The pH was maintained at 7.8 - 8.0 during the entire cooking operation, by injecting aqueous sodium bicarbonate solution.

With the addition of 0.5% Mn as manganous sulfate based on the dry weight of the wood, a pulp having a Kappa number 8.6 and a viscosity of 860 $cm^3/g$ was obtained. Controls without manganese and without the addition of EDTA during the pretreatment process gave pulps whose Kappa number was 13.2 after the same cooking time, and the viscosity was 880 $cm^3/g$. A control with a cooking time of 4.75 hours gave a pulp having a Kappa number of 8.7, and a viscosity of 800 $cm^3/g$. Controls without a pretreatment but with manganese gave a Kappa number of 30.1 after the same cooking time, and the viscosity was 840 $cm^3/g$.

As the results show, the method according to the invention leads to a catalyzed delignification, and to an improved selectivity in the delignification, i.e. a higher viscosity at a given lignin content.

Having regard to the foregoing disclosure, the following is claimed as inventive and patentable embodiments thereof:

1. A process for the delignifcation of raw lignocellulosic material to produce cellulose pulp having a higher viscosity at a given Kappa number which comprises pretreating said lignocellulosic material with a liquid selected from the group consisting of water and aqueous solutions to remove from the lignocellulosic material metal ions and compounds which catalyze the degradation of carbohydrates, and then carrying out the delignification with oxygen and alkali at a pH within the range from about 7 to about 10 in the presence of a catalytically-active manganese compound added in an amount within the range from 0.01 to about 1% by weight Mn based on the dry weight of the lignocellulosic material to improve the selectivity of the delignification and increase the rate of delignification.

2. A process according to claim 1, in which the manganese compound is added prior to the start of the delignification.

3. A process according to claim 1, in which the manganese compound is added at an early stage of the delignification, and before dissolution of approximately 10% of the lignin content of the starting lignocellulosic material.

4. A process according to claim 1, in which the manganese compound is capable of supplying manganese ion to the delignification reaction in a catalytic form.

5. A process according to claim 1, in which the manganese compound is added to the lignocellulosic material at the start of the delignification.

6. A process according to claim 1, in which the manganese compound is added incrementally in the course of the delignification.

7. A process according to claim 1, in which the manganese compound is added continuously in the course of the delignification.

8. A process according to claim 1, in which the manganese compound is impregnated into the lignocellulosic material prior to the delignification with oxygen and alkali.

9. A process according to claim 1, in which the manganese compound is a bivalent manganous compound.

10. A process according to claim 9, in which the manganous compound is selected from the group consisting of manganous oxide, manganous chloride, manganous bromide, manganous hydroxide, manganous nitrite, manganous sulfate, manganous carbonate, manganous phosphate, manganous chlorate, manganous acetate, manganous formate, manganous oxalate, and complex salts of manganous ion with chelating inorganic and organic acids.

11. A process according to claim 1, in which the amount of manganese compound is within the range from about 0.05 to about 0.5% by weight Mn, based on the dry weight of the lignocellulosic material.

12. A process according to claim 1, wherein the pretreating liquid is an aqueous solution which contains a metal complexing agent.

13. A process according to claim 1, wherein the pretreating liquid is water.

14. A process according to claim 1, wherein the pretreating liquid is an aqueous acidic solution.

15. A process according to claim 1, wherein the pretreating liquid is an aqueous alkaline solution comprising at least one alkali selected from the group consisting of sodium carbonate, sodium bicarbonate, and sodium hydroxide.

16. A process according to claim 1, wherein the pretreating liquid is a waste liquor from the oxygen-alkali delignification process.

17. A process according to claim 11, wherein after the pretreatment but prior to the oxygen-alkali delignification the pretreated lignocellulosic material is washed with a member selected from the group consisting of water and acidic and alkaline aqueous solutions.

18. A process according to claim 1, wherein the oxygen-alkali delignification process is effected at an oxygen partial pressure of at least 5 bars.

19. A process according to claim 1 in which the lignocellulosic material is wood in the form of particles having a wood structure, and the oxygen-alkali delignification is carried out at an oxygen partial pressure of at least 10 bars.

20. A process according to claim 1, wherein the temperature for the major part of the delignification is maintained within the range from about 120° to about 160° C.

21. A process according to claim 1, in which the lignocellulosic material is wood in the form of particles having a wood structure, and the temperature is maintained within the range from about 130° to about 150° C for the major part of the delignification.

22. A process according to claim 1, wherein a magnesium compound is added as a cellulose degradation inhibitor during the delignification.

* * * * *

UNITED STATES PATENT OFFICE

CERTIFICATE OF CORRECTION

Patent No. 4,087,318 Dated May 2, 1978

Inventor(s) Hans Olof Samuelson et al.

It is certified that error appears in the above-identified patent and that said Letters Patent are hereby corrected as shown below:

[30] "7403451" should be --7403451-3 --
[57] line 4, following "remove" insert --metal ions and--
Column 6, line 19, "hyrolyzed" should be --hydrolyzed--
Column 8, line 7, "oyxgen" should be --oxygen--
Column 9, line 61, "polysaccarides" should be --polysaccharides--
Column 10, line 28, "delignificationn" should be --delignification--
line 32, delete "hydroxide," and insert --the--
line 33, "hydroxicde" should be --hydroxide--
Column 13, lines 15, 16 & 17, delete "potassium monohydrogen phosphate, sodium dihydrogen phosphate,"

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*